US008490803B2

(12) United States Patent
Harris

(10) Patent No.: US 8,490,803 B2
(45) Date of Patent: Jul. 23, 2013

(54) BABY BOTTLE WITH MIXING DEVICE

(76) Inventor: LaShana M. Harris, Frankfort, KY (US)

( * ) Notice: Subject to any disclaimer, the term of this patent is extended or adjusted under 35 U.S.C. 154(b) by 0 days.

(21) Appl. No.: 13/134,369

(22) Filed: Jun. 6, 2011

(65) Prior Publication Data

US 2012/0305514 A1 Dec. 6, 2012

(51) Int. Cl.
*A61J 9/04* (2006.01)

(52) U.S. Cl.
USPC ..... 215/11.4; 215/11.6; 222/145.5; 206/219

(58) Field of Classification Search
USPC ..... 220/23.83, 23.86, 501; 215/11.1, 215/11.4, 11.5, 11.6, DIG. 8, 6, 329; 206/219, 206/221, 216, 568; 222/129.1, 145.5, 145.6
See application file for complete search history.

(56) References Cited

U.S. PATENT DOCUMENTS

| | | | | |
|---|---|---|---|---|
| 5,275,298 | A | 1/1994 | Holley, Jr. et al. | |
| 5,419,445 | A | 5/1995 | Kaesemeyer | |
| 5,794,802 | A | 8/1998 | Caola | |
| 6,045,254 | A | 4/2000 | Inbar et al. | |
| 6,616,319 | B2 | 9/2003 | Renz | |
| 7,036,975 | B2 | 5/2006 | Renz | |
| 7,098,431 | B2 * | 8/2006 | Chia Salido et al. | 219/725 |
| 7,637,382 | B2 * | 12/2009 | Kraus et al. | 215/11.1 |
| 8,028,847 | B2 * | 10/2011 | Klaver et al. | 215/6 |
| 8,146,758 | B1 * | 4/2012 | Peres | 215/6 |
| 2003/0205548 | A1 | 11/2003 | Seckler | |
| 2007/0221601 | A1 | 9/2007 | Eitrheim et al. | |
| 2009/0127221 | A1 | 5/2009 | Nasrallah | |
| 2011/0297634 | A1 * | 12/2011 | Diaz | 215/11.4 |
| 2012/0318765 | A1 * | 12/2012 | Questad et al. | 215/11.1 |

* cited by examiner

*Primary Examiner* — Mickey Yu
*Assistant Examiner* — Kareen Rush
(74) *Attorney, Agent, or Firm* — Carrithers Law Office PLLC

(57) ABSTRACT

A baby bottle including a nipple and separable compartments for holding powdered formula and water. By sliding or rotating a knob to a pre-selected mix position, apertures in the separable compartments are aligned thereby allowing mixture of the powdered formula from an upper compartment into a lower compartment containing the water. The bottle is shaken to thoroughly mix the formula and the water, after which, the bottle and formula mix are ready to use.

2 Claims, 4 Drawing Sheets

BABY BOTTLE WITH MIXING DEVICE

TECHNICAL FIELD

The present invention relates to the field of baby bottles and in particular to baby bottles including separable compartments for storage of a dry powder (powdered formula) and a liquid (water) prior to use and means releasing, combining and for mixing same.

BACKGROUND OF THE INVENTION

Powdered baby formula is mixed with water to produce a liquid formula milk replacement for consumption by infants. The dry powdered formula may be stored for long periods of time without refrigeration. However, once the powdered formula is mixed with water, the liquid formula must either be used or refrigerated within a short period of time. Otherwise the liquid formula spoils.

Powdered baby formula and water are typically mixed by combining predetermined amounts of powdered formula and water in the bottle, attaching the nipple and lid, and shaking the baby bottle to thoroughly mix the powder with the water. This mixing process may be safely and accurately performed with the aid of suitable measuring devices and substantially sterile surroundings. In addition, the mixed liquid formula and bottle may be stored and refrigerated for later use.

However, where refrigeration is unavailable, it is necessary to perform the mixing process just before use. If proper measuring devices and substantially sterile surroundings are unavailable, the process becomes problematic because contamination, spillage and the production of incorrectly mixed formula can occur. When traveling, it is inconvenient to carry formula and water separately and to measure out and mix the ingredients every time formula is needed for a baby.

DESCRIPTION OF THE RELATED ART

U.S. Pat. No. 5,275,298 by Holley, Jr. teaches a multi-component bottle with a mixing valve including a ball valve body which is rotated to align two sets of apertures to release the powdered formula into the lower water compartment for mixing. Holley stores the powdered formula within the hollow ball portion of the ball valve. Holley requires the alignment of two pairs of apertures and uses a complex ball valve with a cam arrangement for opening and closing the valve, unlike the present invention which only requires alignment of an aperture of a rotatable disk and a fixed disk.

U.S. Pat. No. 5,794,802 by Caola teaches a multi-component bottle with a push rod under the nipple which is used to force open a valve member. Caola's valve doesn't involve the alignment of two apertures or the same type of sliding element for opening as is used in the present invention.

U.S. Pat. No. 6,045,254 by Inbar et al teaches a movable plug in a necked down portion of the bottle to separate the powder from the water. Turning a top portion of the bottle raises the plug and allows the powder to fall into the liquid U.S. Pat. No. 5,419,445 by Kaesemeyer has a sealing member between upper and lower compartments which is dislodged by twisting a lid portion on the top of the bottle. The sealing member falls to the bottom of the container. A user can't easily see when the sealing member is dislodged.

SUMMARY OF THE INVENTION

The present invention provides a baby bottle including a nipple and separable compartments for holding powdered formula and water. By sliding or rotating a knob to a preselected mix position, apertures in the separable compartments are aligned thereby allowing mixture of the powdered formula from an upper compartment into a lower compartment containing the water. The bottle is shaken to thoroughly mix the formula and the water, after which, the bottle and formula mix are ready to use.

More particularly, with the present invention, there is provided a combination baby bottle and powdered formula and water storage device comprising a lid with a nipple, a two part mixing valve and a water compartment. The lid is a cylindrically shaped lid including a top wall, a first sidewall, and a nipple. The first sidewall contains first female threads. The top wall has a circular aperture formed therein sized to receive the nipple and the bottom surface of the top wall abuts a top surface of the outer marginal portion of the nipple. The first part of the two part valve is a cylindrically shaped stationary valve member includes a second sidewall with first male threads at a top edge. The first male threads are capable of being threaded into the first female threads to connect the lid to the stationary valve member. The stationary valve member includes a first circular bottom wall having a first aperture formed therein. The first aperture is sized to fit within a one third circular sector of the first bottom wall and is located so as not to include the center point of the first bottom wall. The second sidewall extends below the first bottom wall and includes second female threads. The second sidewall has a slot formed therein, the slot is above and parallel to the second bottom wall and extends around one third of the circumference of the second sidewall. The second part of the two part valve is a cylindrically shaped movable valve member having a third sidewall and a second bottom wall. The third sidewall has a first circumferential groove formed within the outside surface thereof which is located near a top edge. The third sidewall has a second circumferential groove formed within the outside surface and is located near the bottom edge. The first and the second grooves each have an polymeric or elastomeric sealing means such as an O-ring, washer, or disc disposed therein. The movable valve member is capable of being inserted within the stationary valve member whereupon the first bottom wall abuts the second bottom wall and the O-rings form a leak-proof seal between the second sidewall and the third sidewall. The slot is therefore situated between the O-rings and is sealed from leaking. The third sidewall has a rectangular window formed therein and located between the first groove and the second groove. The window contains a vertical axle with a lever pivoting thereon. The back side of the window is sealed off with a box which is integral with the third sidewall. The lever is capable of being fully contained within the window and the box and is capable of being pivoted out through the slot to a position where a user can push the lever to spin the movable valve member within the stationary valve member. The second circular bottom wall has a second aperture which is sized to fit within a one third circular sector of the second bottom wall. The second aperture is the same size as the first aperture and is located so as not to include the center point of the second bottom wall. The first aperture and the second aperture are totally mis-aligned when the lever is at a first end of the slot, thus keeping the formula powder separate from the water. The first aperture and the second aperture are totally aligned when the lever is at a second end of the slot. The cylindrically shaped water compartment includes a bottom wall and a fourth sidewall with second male threads at a top edge which are capable of being threaded into the second female threads to connect the stationary valve member to the water compartment.

It is an object of the present invention to provide a pair of apertures contained in a rotatable disk and a fixed disk alignable whereby visible movement and positioning of same is clearly visible upon movement of an adjustment means such as a tab or knob located on the outside of the container.

It is an object of this invention to provide a baby bottle and storage device which separately stores dry formula and water for subsequent mixing and feeding.

It is an object of this invention to provide a baby bottle and storage device which provides any easy to use formula and water mixing valve.

It is an object of this invention to provide a baby bottle and storage device which provides a convenient and easily recognizable indication as to whether the mixing valve is open or closed.

It is an object of this invention to provide a baby bottle and storage device which is easily disassembled for cleaning.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
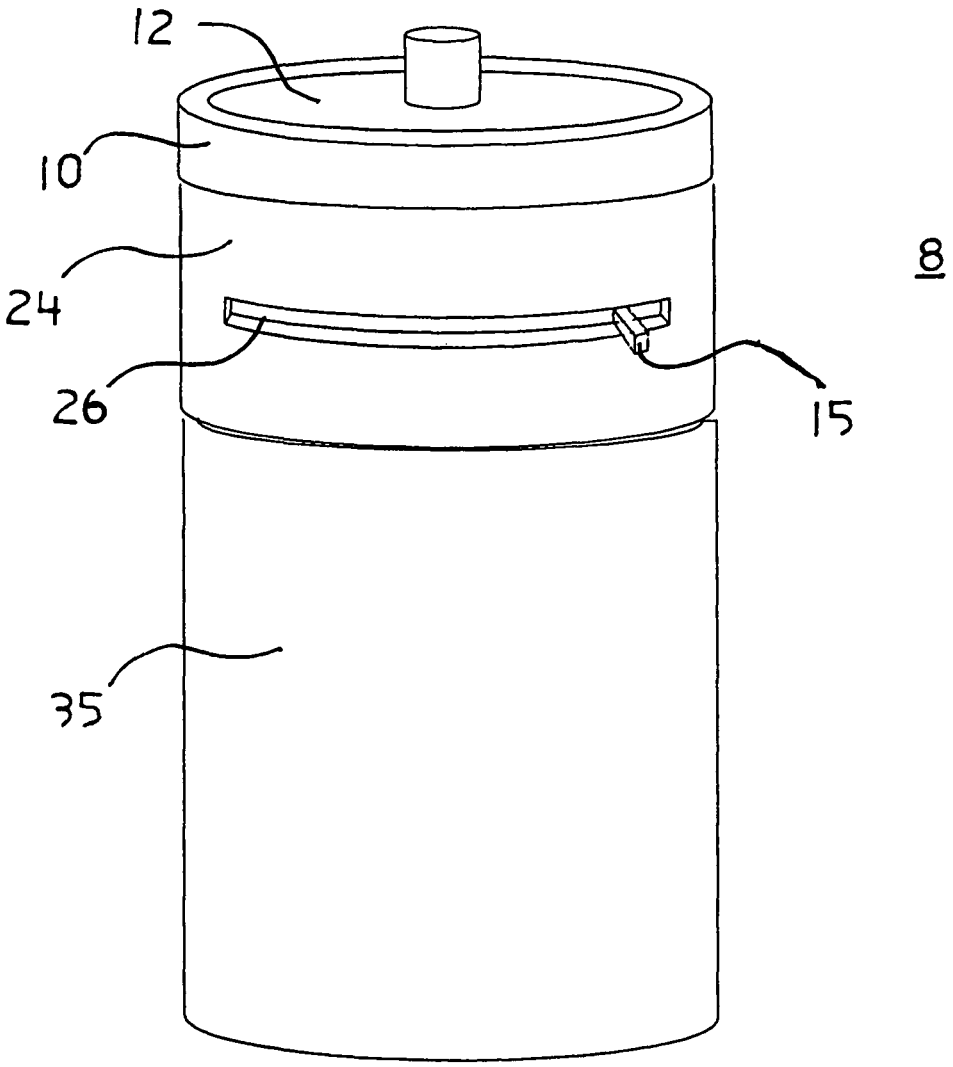
FIG. 1 is a front perspective view of the baby bottle.
Figure 2:
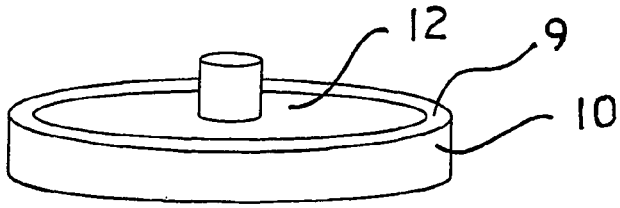
FIG. 2 is a perspective view of a lid with a nipple installed.

FIG. 1 shows a baby bottle 8 including a lid 10 with a nipple 12, a stationary mixing valve member 24 with a slot 26 and a mixing lever 15, and a water compartment 35. FIGS. 2-5 show the individual components. Lid 10, stationary mixing valve member 24 and water compartment 35 are cylindrical in shape.

Figure 3:
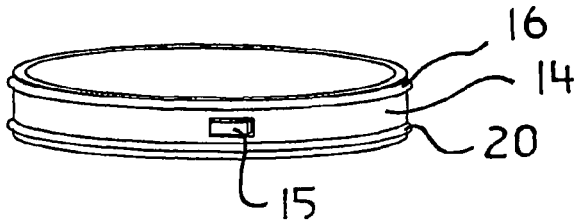
FIG. 3 is a perspective view of the movable portion of the mixing valve.
Figure 9:
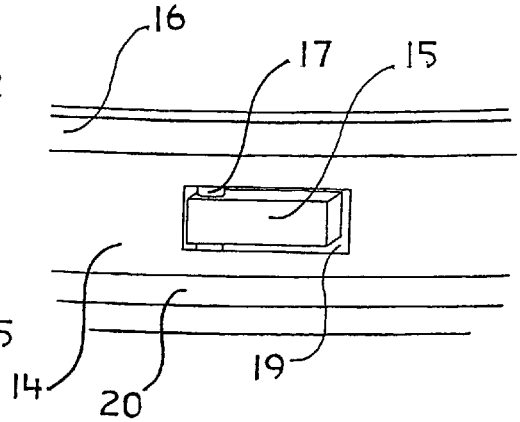
FIG. 9 is a close up view of the opening lever on the movable portion of the mixing valve shown in FIG. 3.

FIG. 3 shows the movable mixing valve member 14 which is inserted into the top opening 21 of stationary mixing valve member 24 in preparation for use. Movable valve member 14 has an outer diameter which is slightly less than the inner diameter of opening 21 of stationary valve member 24 and includes sealing means comprising circumferential bands or most preferably O-rings 16 and 20 trapped within circular grooves surrounding the outside of the sidewall of movable valve member 14. O-rings 16 and 20 provide a seal as movable valve member 14 is pressed down into stationary valve member 24. As shown in FIG. 9, lever 15 pivots on axle 17 in the side wall of movable mixing valve member 14. Leak proof storage housing or box 13 is an integral part of the sidewall of movable valve member 14 and contains lever 15 and axle 17 so that powder stored within movable valve member 14 or liquid which is released into movable valve member 14 will not escape through window 19 in the outer sidewall of movable valve member 14. Lever 15 must be able to rotate out of the way into the storage position as shown in FIG. 9 while inserting movable valve member 14 into stationary valve member 24.

Figure 8:
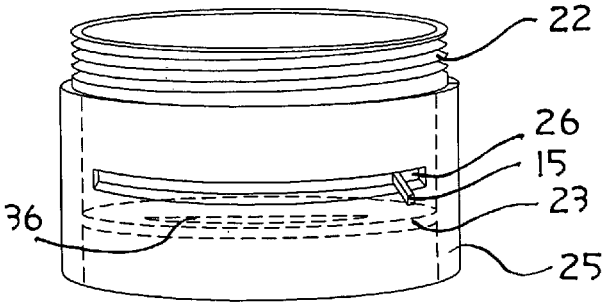
FIG. 8 is a perspective view of the stationary portion of the mixing valve showing the opening lever extended and ready for use.

When inserting movable valve member 14 into stationary valve member 24, bottom wall 11 of movable mixing valve member 14 is pressed down and seated against the bottom wall 23 of stationary valve member 24. Bottom wall 23 has a crescent shaped aperture 36. FIG. 8 shows bottom wall 23 and crescent aperture 36 in phantom lines. Bottom wall 11 of movable valve member 14 has a crescent shaped aperture 37. Once movable valve member 14 is placed inside stationary valve member 24, lever 15 may be swung out to a usable position as shown in FIG. 1.

Lower portion 25 of stationary valve member 24 extends below bottom wall 23 and contains internal female threads (not shown) which are threaded onto male threads 32 to connect stationary valve member 24 to water compartment member 35.

Figure 4:
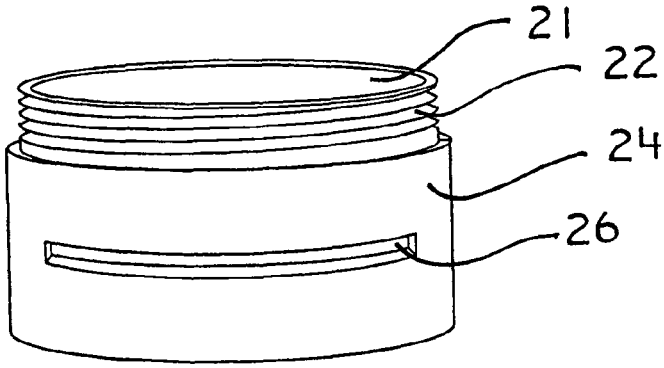
FIG. 4 is a perspective view of the stationary portion of the mixing valve.
Figure 5:
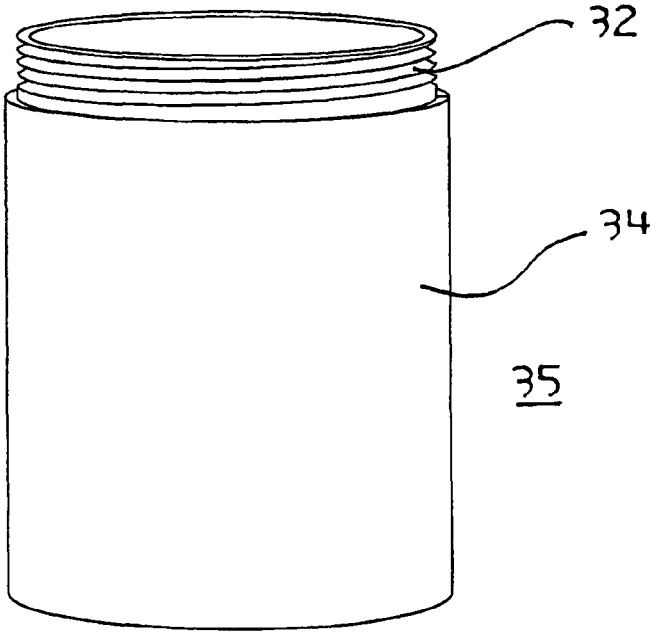
FIG. 5 is a perspective view of the water compartment.
Figure 6:
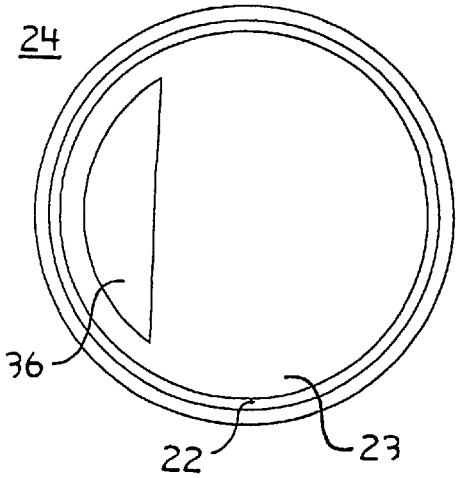
FIG. 6 is a top view of the stationary portion of the mixing valve.
Figure 7:
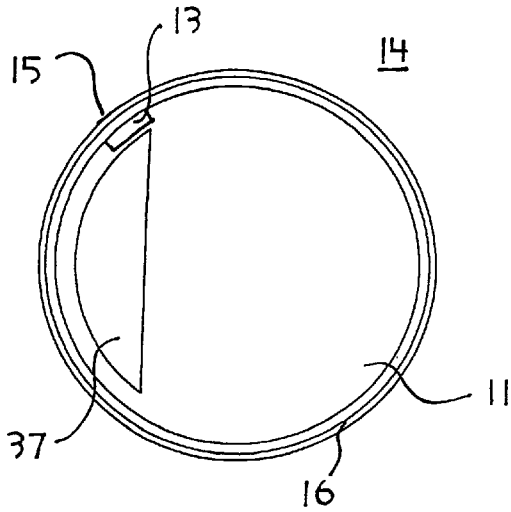
FIG. 7 is a top view of the movable portion of the mixing valve.

Lid 10 includes female threads (not shown) which are threaded onto male threads 22 of stationary mixing valve member 24, shown in FIG. 4. Lid 10 also includes a top wall 9 containing an aperture through which is inserted a nipple 12. The outer marginal edge of nipple 12 is compressed securely between top wall 9 of lid 10 and the upper edge of stationary valve member 24 to form a leak proof fit. Water compartment member 35 includes sidewall 34, male threads 32 and a bottom wall (not shown). It is understood that when the baby bottle is fully assembled, the threads connecting lid 10, stationary valve member 24 and water compartment 35 forma water tight seal so that baby bottle 8 does not leak during use.

To use the bottle, a user first puts lever 15 in the storage position as shown in FIG. 9. Then the user puts inserts valve member 14 down into stationary valve member 24 so that bottom wall 11 of movable mixing valve member 14 is pressed down and seated against the bottom wall 23 of stationary valve member 24. Once movable valve member 14 is placed inside stationary valve member 24, lever 15 is swung out to a usable position as shown in FIG. 1. (With lever 15 in this position, apertures 36 and 37 are totally mis-aligned so that the powdered formula is prevented from dropping into water compartment 35.) Next the user puts a selected amount of water in water compartment 35. Then the user threads stationary valve member 24 onto water compartment 35 tightly. Then a selected amount of powdered formula is put into the stationary valve member 24. Finally, lid member 10 (including nipple 12) is threaded tightly onto male threads 22 of stationary valve member 24.

Figure 10:
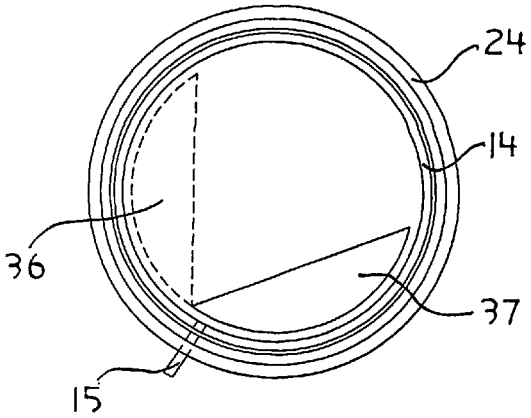
FIG. 10 is a top view of movable valve member 14 inside stationary valve member 24 with the apertures 36 and 37 mis-aligned.
Figure 11:
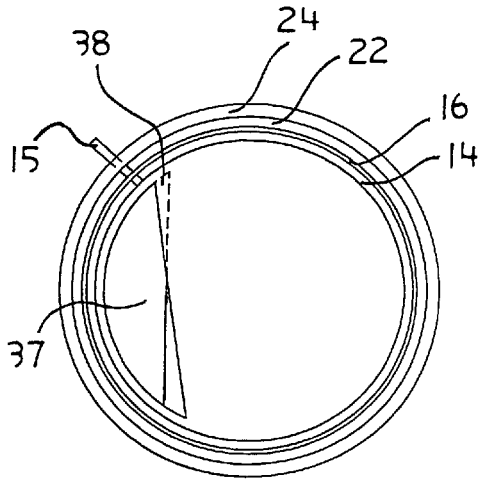
FIG. 11 is a top view of movable valve member 14 inside stationary valve member 24 with the apertures 36 and 37 almost completely aligned.

In the travel or storage mode, as shown in FIG. 10, movable valve member 14 is positioned within stationary valve member 24 such that the apertures 36 and 37 are totally mis-aligned. FIG. 11 shows lever 15 and movable valve member 14 have been moved almost all the way to a position where apertures 36 and 37 are aligned and there is just a small part 38 of aperture 37 which is still covered. When a user wants to mix the water and powdered formula, lever 15 is moved all the way to the left end of slot 26. This causes apertures 36 and 37 to become aligned and the formula will fall into the water. However, it can be seen that even if the apertures are only partially aligned, mixing of the water and powdered formula will still occur. Now the baby bottle is shaken and is ready to use. It is understood that apertures of other shapes such as round, square, triangular can be used instead of crescent and the selected shape is a matter of choice. In one preferred embodiment, the apertures in the valve members are sized to fit within a one third circular sector, that is, a circular sector of 120°, or less so that the movable valve must not be moved an excessive amount to align the apertures. Further, slot 26 would only extend one third of the way around the stationary valve member 24.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A baby bottle mixing device for mixing a liquid and powder, comprising:

a cylindrically shaped lid including a top wall, a first sidewall, and an elastomeric nipple, said first sidewall containing a first set of female threads, said top wall having a circular aperture formed therein sized to receive said nipple, a bottom surface of said top wall abutting a top surface of an outer marginal portion of said nipple;

a cylindrical stationary valve member including a second sidewall with a first set threads at a top edge, a first set of male threads cooperatively engaging said first set of female threads connecting said lid to said stationary valve member, a first circular bottom wall having a first aperture formed therein, said first aperture being sized to fit within a one third circular sector of said first bottom wall, said first aperture disposed between a side edge and a center point of said first bottom wall, said second sidewall extending below said first bottom wall and including second female threads, said second sidewall having a slot formed therein, said slot disposed above and parallel to a second bottom wall, said slot extending around one third of a circumference of said second sidewall;

a cylindrical shaped movable valve member having a third sidewall and a second bottom wall, said third sidewall having a first circumferential groove formed within an outside surface thereof and located near a top edge thereof, said third sidewall having a second circumferential groove formed within an outside surface thereof and located near a bottom edge thereof, said first and said second grooves each including sealing means disposed therein, said movable valve member insertable within said stationary valve member whereupon said first bottom wall abuts said second bottom wall and said sealing means forming a leak-proof seal between said second sidewall and said third sidewall, said slot being situated between said grooves, said third sidewall having a rectangular window formed therein and located between said first groove and said second groove, said window containing a vertical axle with a lever pivoting thereon, the back side of said window being sealed off with a box, said box being integral with said third sidewall, said lever capable of being fully contained within said window and said box and capable of being pivoted out through said slot to a position where a user can push said lever to spin said movable valve member within said stationary valve member, a second circular bottom wall having a second aperture formed therein, said second aperture sized to fit within a one third circular sector of said second bottom wall, said second aperture is of the same size as said first aperture, said second aperture extending from a side edge and a center point of said second bottom wall;

said first aperture and said second aperture being misaligned when said lever is at a first end of said slot in a closed position and said first aperture and said second aperture being aligned when said lever is at a second end of said slot in a open position; and a cylindrical water compartment including a bottom wall and a fourth sidewall with a set of second male threads at a top edge, said second set of male threads threadably engageable with said second female threads connecting said stationary valve member to said water compartment.

2. The baby bottle mixing device of claim 1, wherein said sealing means is selected from the group consisting of an o-ring, a circumferential band, and combinations thereof.

* * * * *